US007422499B2

(12) United States Patent
Nakatsuji

(10) Patent No.: US 7,422,499 B2
(45) Date of Patent: Sep. 9, 2008

(54) OPERATION DEVICE FOR A WATER-JET PROPULSION WATERCRAFT

(75) Inventor: Akira Nakatsuji, Shizuoka-ken (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 59 days.

(21) Appl. No.: 11/366,276

(22) Filed: Mar. 2, 2006

(65) Prior Publication Data

US 2006/0234568 A1 Oct. 19, 2006

(30) Foreign Application Priority Data

Mar. 2, 2005 (JP) ..... 2005-057662

(51) Int. Cl.
*B63H 11/11* (2006.01)

(52) U.S. Cl. ..... 440/41

(58) Field of Classification Search ..... 440/84–87, 440/40–43, 63; 74/480 B
See application file for complete search history.

(56) References Cited

U.S. PATENT DOCUMENTS 3,295,490 A * 1/1967 Hiatt ..... 440/40
4,964,821 A * 10/1990 Tafoya ..... 440/38

FOREIGN PATENT DOCUMENTS

JP 02-147492 6/1990
JP 10236387 A * 9/1998

* cited by examiner

*Primary Examiner*—Ed Swinehart
(74) *Attorney, Agent, or Firm*—Knobbe, Martens, Olson & Bear, LLP

(57) ABSTRACT

An operation device for a water-jet propulsion watercraft includes a first rotational shaft and a second rotational shaft. A first link can be rotatable about the first rotational shaft and a second link can be rotatable about the second rotational shaft. A bridging link can be configured to be capable of moving in parallel. A rotational end of the first link and a rotational end of the second link can be coupled such that an imaginary straight line connecting the rotational end to the first rotational shaft is parallel to an imaginary straight line connecting the rotational end to the second rotational shaft. A holding section can be provided on the bridging link to be held and operated by an operator.

17 Claims, 12 Drawing Sheets

Exhibit A

Exhibit A (a)

(b)

OPERATION DEVICE FOR A WATER-JET PROPULSION WATERCRAFT

PRIORITY INFORMATION

This application claims priority to Japanese patent application Ser. No. 2005-057662, filed on Mar. 2, 2005, the entire contents of which is hereby expressly incorporated by reference.

BACKGROUND OF THE INVENTIONS

1. Field of the Inventions

The present inventions relate to operation devices for water-jet propulsion watercraft, and more particularly, operation devices disposed in the operator's area of such watercraft.

2. Description of the Related Art

Small jet-propelled watercraft, which can be sporting in nature, are widely used in many-different types of bodies of water. In this type of watercraft, water is drawn upwardly from the bottom of the hull by a jet pump and is emitted rearwardly through a steering nozzle at the stern of the watercraft. The nozzle can be swung leftward and rightward about a rotational shaft so that the jet of water discharged through the nozzle can be diverted and thereby turn the watercraft in any desired direction.

These types of watercraft also usually include another device for diverting the water jet, and in this case, in order to provide reverse thrust. For example, such devices are often referred to as "reverse buckets". Reverse buckets are typically mounted rearward from the steering nozzle and configured to move between retracted and deployed positions. In the retracted position, the reverse bucket does not contact the water jet discharged form the steering nozzle. However, in the deployed position, the bucket diverts the water jet, usually downwardly and forwardly so as to generate at least some reverse direction thrust.

Typically, watercraft equipped with such reverse buckets include a shift lever (hereinafter referred to as an "operation member") configured to control the movement of the reverse bucket between the deployed and retracted positions. Such operation members can be mounted for rotation or pivoting about its axis. In some watercraft, when the operation member is pushed forwardly, the reverse bucket is moved into its retracted position, thereby allowing the watercraft to operate in a normal forward thrust mode. On the other hand, when such an operation members is pulled rearwardly, the reverse bucket is moved in to the deployed position, allowing the watercraft to operate in a reverse thrust mode.

Japanese Patent Document JP-B-2690981 discloses such an operation member for controlling a reverse bucket. For example, at page 2, lines 41 through 48 (right side column) and FIG. 4, this document explains that an "operation member of an advancing and reversing-changeover bucket is disposed with reach of the operator's hand in the bull at a position different than the operation handle. The operation member is connected to the bucket at one side by a cable, and the operation member protruded outward from an opening provided in the upper deck is operated to thereby rotate the bucket about its axis through a cable for the changeover between advancing and reversing."

SUMMARY OF THE INVENTIONS

An aspect of at least one of the embodiments disclosed herein includes the realization that in reverse bucket designs such as that shown in Japanese Patent Document JP-B-2690981, operation member is operated for rotation about a rotational shaft, and thus the total linear movement of the handle of the operation member can be quite large. As such, the operators using such a reverse bucket system may be required to move their arm a large distance which may require them to also move their body, which can be uncomfortable.

Additionally, since the operation member is mounted for rotation about one rotational shaft disposed beneath the upper deck, a relatively large opening is provided through the upper deck to accommodate the rotating range of the operation member. If a large opening is provided, water right enter the hull from the opening more easily.

Thus, in accordance with one embodiment, an operation device for a water-jet propulsion watercraft can be provided. The operation device can include a first and a second rotational shaft provided parallel to each other in a hull of the watercraft. A first link can be rotatable about the first rotational shaft and a second link can be rotatable about the second rotational shaft. A bridging link with a rotational end of the first link and a rotational end of the second link can be coupled such that an imaginary straight line connecting the rotational end of the first link to the first rotational shaft is parallel to an imaginary straight line connecting the rotational end of the second link to the second rotational shaft. The bridging link can have at least an operator's seat side end and a portion near the operator's seat side end extending approximately parallel to an imaginary straight line connecting the rotational ends and capable of moving in parallel. A holding section can be provided on the bridging link to be held and operated by an operator of the watercraft. Additionally, a reciprocating movement of the holding section can be transmitted to an engine output control device or a propelling direction changing device through the bridging link, the first link, and the second link.

In accordance with another embodiment, an operation device for a water-jet propulsion watercraft can be provided. The operation device can include an engine driving a jet pump. An output control device can be configured to control an output of the engine. A reverse bucket can be disposed on the jet pump. A user operable handle can be disposed in the hull and can be configured to allow the user to input control commands to at least one of the output control device and the reverse bucket. Additionally, means can be provided for guiding the handle through a generally linear movement.

BRIEF DESCRIPTION OF THE DRAWINGS

The above-mentioned and other features of the inventions disclosed herein are described below with reference to the drawings of preferred embodiments. The illustrated embodiments are intended to illustrate, but not to limit the inventions. The drawings contain the following Figures.

DETAILED DESCRIPTION OF THE PREFERRED EMBODIMENTS

Figure 1:
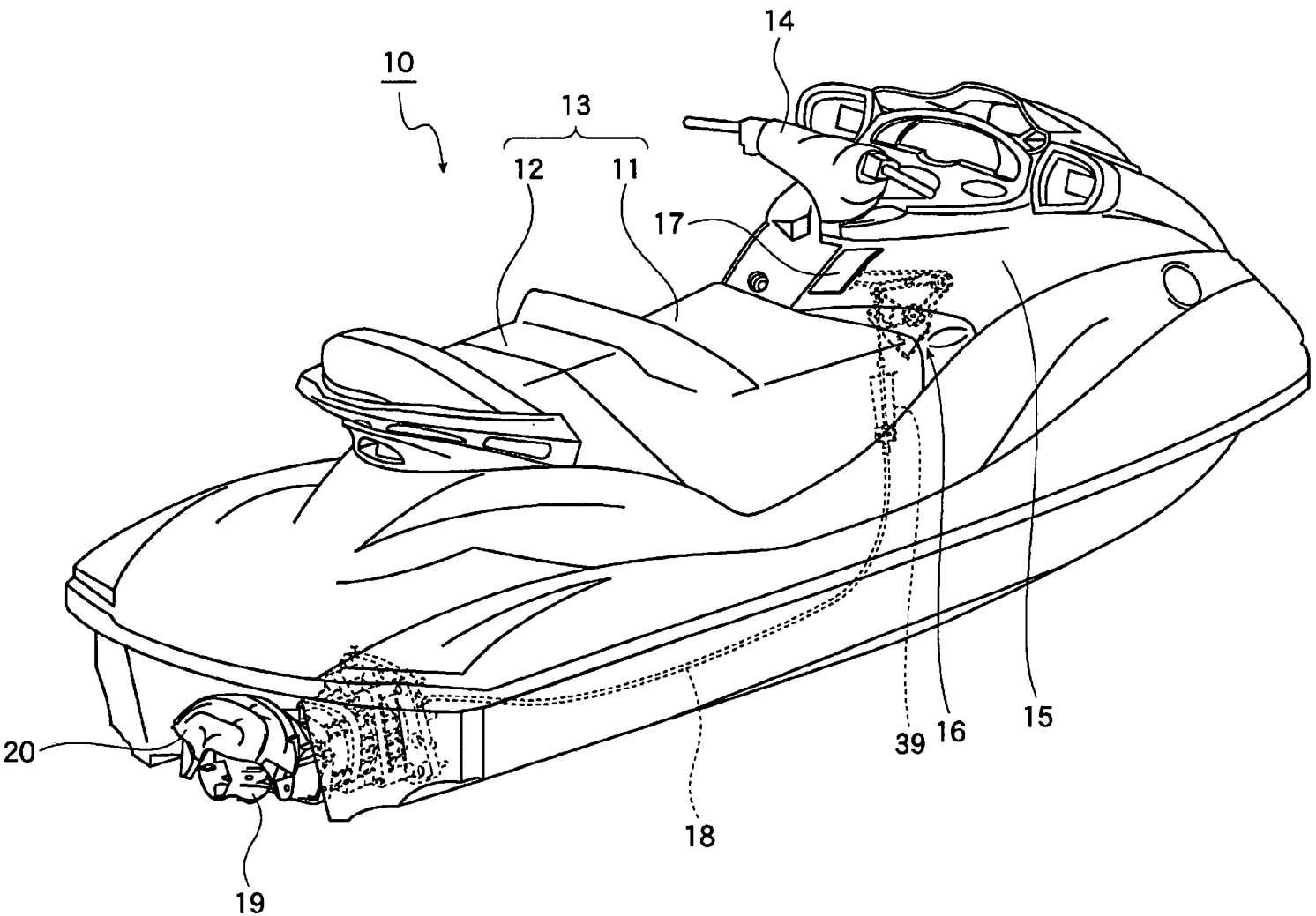
FIG. 1 is a perspective view of a water-jet propulsion watercraft according to an embodiment.

FIG. 1 illustrates a small planing boat 10 (also commonly referred to as a "personal watercraft") that can include embodiments of the present operation devices. The present operation devices are illustrated in the context of a personal watercraft because they have particular utility in this context. However, the present operation devices can also be used in other vehicles, including small jet boats, as well as other watercraft and land vehicles.

The water-jet propulsion watercraft 10 can include, as shown in FIG. 1, a seat 13 having a control section 11 for an operator and a rear seat section 12 for rear seat passengers. Handle bars 14 can be mounted for operation by an operator of the watercraft 10. A cover 15 for covering a deck can also be provided. A link mechanism 16 can be covered by the cover 15 and provided on the deck. Additionally, a holding section 17 (or a "handle") can be mounted to the link mechanism 16 for operation by the operator.

The water-jet propulsion watercraft 10 can be provided with an advancing and reversing-changeover bucket 20 (hereinafter referred to as a "reverse bucket"). The reverse bucket 20 can be connected to the link mechanism 16 for adjusting the direction of a jet stream discharged from the opening of a nozzle 19 provided on the rear side of the watercraft 10 any type of connecting mechanism can be used to connect the reverse bucket 20 with the link mechanism 16. In some embodiments, the reverse bucket 20 is connected to the link mechanism 16 with a push-pull cable 18.

An operator of the watercraft 10 can move the reverse bucket 20 between retracted and deployed positions by moving the holding section 17. For example, when the operator moves the holding section 17, the cable 18 is moved by the movement of the link mechanism 16 and us moves the reverse bucket 20 between its deployed in retracted positions. When the reverse bucket 20 is in the fully retracted position, it does not substantially divert the jet of water discharged through the nozzle 19. When the reverse bucket 20 is in the fully deployed position, it diverts the jet of water discharged through the nozzle 19 generally downwardly and forwardly, and thereby generates reverse thrust. However, as describing greater detail below, the reverse bucket 20 can also been moved to intermediate positions between the fully deployed and fully retracted positions.

With reference to FIGS. 2-6, the link mechanism 16 can be provided with a plate-like bracket 30 for fixing the link mechanism 16 to the water-jet propulsion watercraft 10. On the plate-like bracket 30, and in some embodiments, a first link, or a right link 33, can be supported by a rotational shaft 31 and a second link, or a left link 14, can be supported at one end by a second rotational shaft 32.

The first rotational shaft 31 and the second rotational shaft 32 can be disposed with their axes parallel to each other. The right link 33 can be rotated about the first rotational shaft 31 and having a right link rotational end 35 at the rotating end, and the left link 34 can be rotated about the second rotational shaft 32 and having a left link rotational end 36 at the rotating end.

The right link 33 and the left link 34 can be disposed such that an imaginary straight line connecting the right link rotational end 35 and the first rotational shaft 31 can be parallel to an imaginary straight line connecting the left link rotational end 36 and the second rotational shaft 32.

A bridging link 37 can be mounted to the right link rotational end 35 and the left link rotational end 36 for connecting these rotational ends 35, 36. The bridging link 37 can extend toward the operator's seat, or the control section 11. The bridging link 37 can be disposed between the right link 33 and left link 34 when viewed in the direction perpendicular to the first rotational shaft 31 and the second rotational shaft 32. Therefore, when the right link 33 and the left link 34 are rotated about the first rotational shaft 31 and the second rotational shaft 32 in a parallel relation to each other, respectively, the bridging link 37 makes an approximately back-and-forth parallel motion.

The bridging link 37 can be provided, at the end on the control section 11 side, with a holding section 17 held and operated by an operator. When the bridging link 37 makes a parallel motion, the holding section 17 can also make a parallel motion.

The end of the wire 18 can be coupled to the right link 33 at the corner in a region spaced from the rotational ends 35, 36 for transmitting the motion of the holding section 17 to the advancing and reversing-changeover bucket 20.

Figure 8:
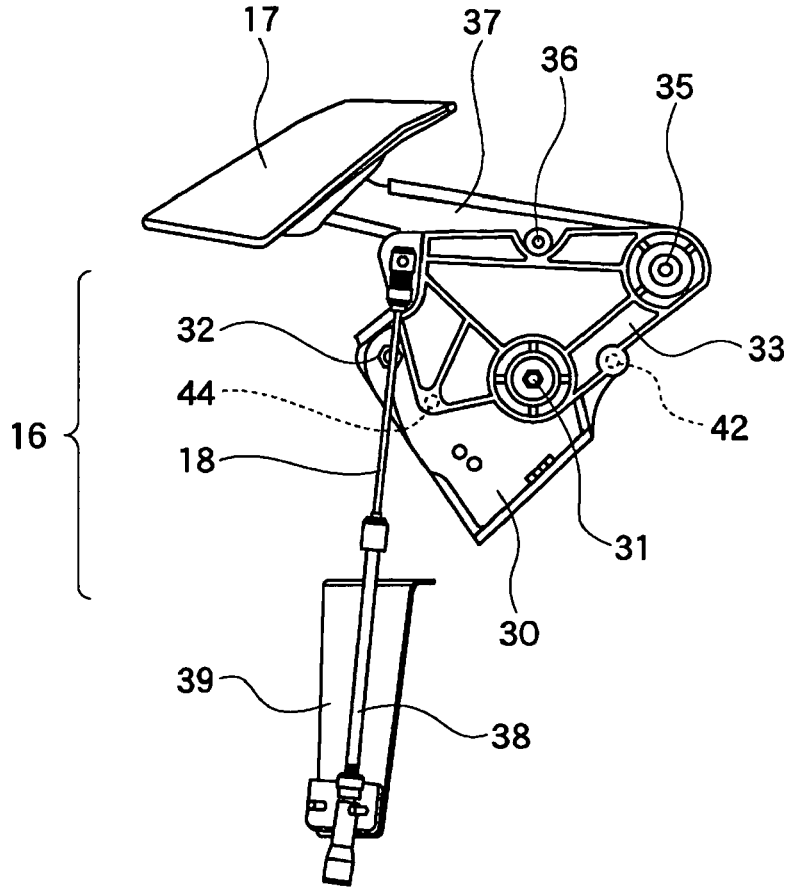
FIG. 8 is a schematic view showing a relation between the movement of the link mechanism and a reverse bucket when the watercraft is in the forward thrust mode.
Figure 8:
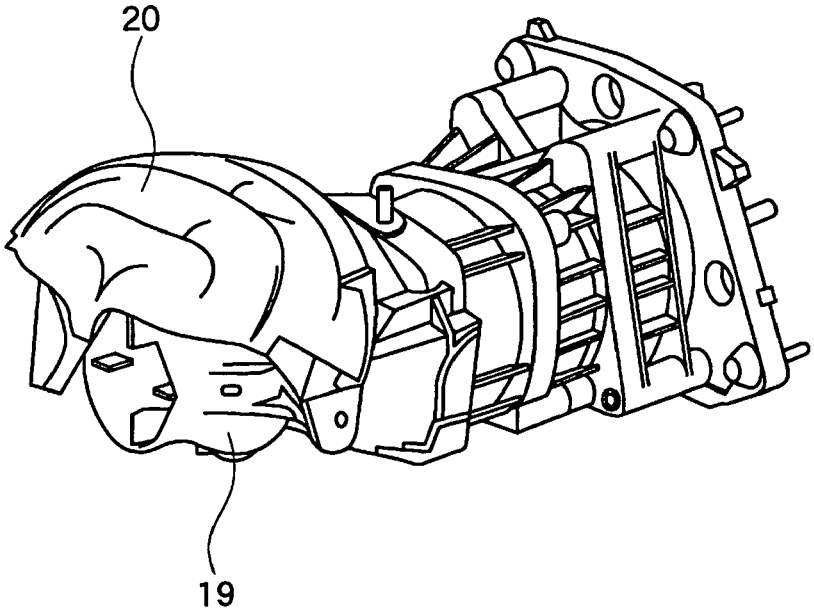

When the holding section 17 is pushed forwardly, the bridging link 37 can make a forward parallel motion and the right link 33 can be rotated clockwise about the first rotational shaft 31, as shown in FIG. 8. The wire 18 can be fixed at one end to the plate-like bracket 30 and at the other end to the advancing and reversing-changeover bucket 20 as a propelling direction changing device, as shown in FIG. 8.

Therefore, the wire 18 can be pulled through a wire tube 38 attached to the inner side of the water-jet propulsion watercraft 10, and the movement of the holding section 17 can be transmitted to the advancing and reversing-changeover bucket 20 to raise the advancing and reversing-changeover bucket 20 so that the opening of the nozzle 19 can be opened. As a result, a jet stream can be directed rearward from the nozzle 19 without being blocked, resulting in an advancing state of the water-jet propulsion watercraft 10, or in other words, a forward thrust mode.

Figure 9:
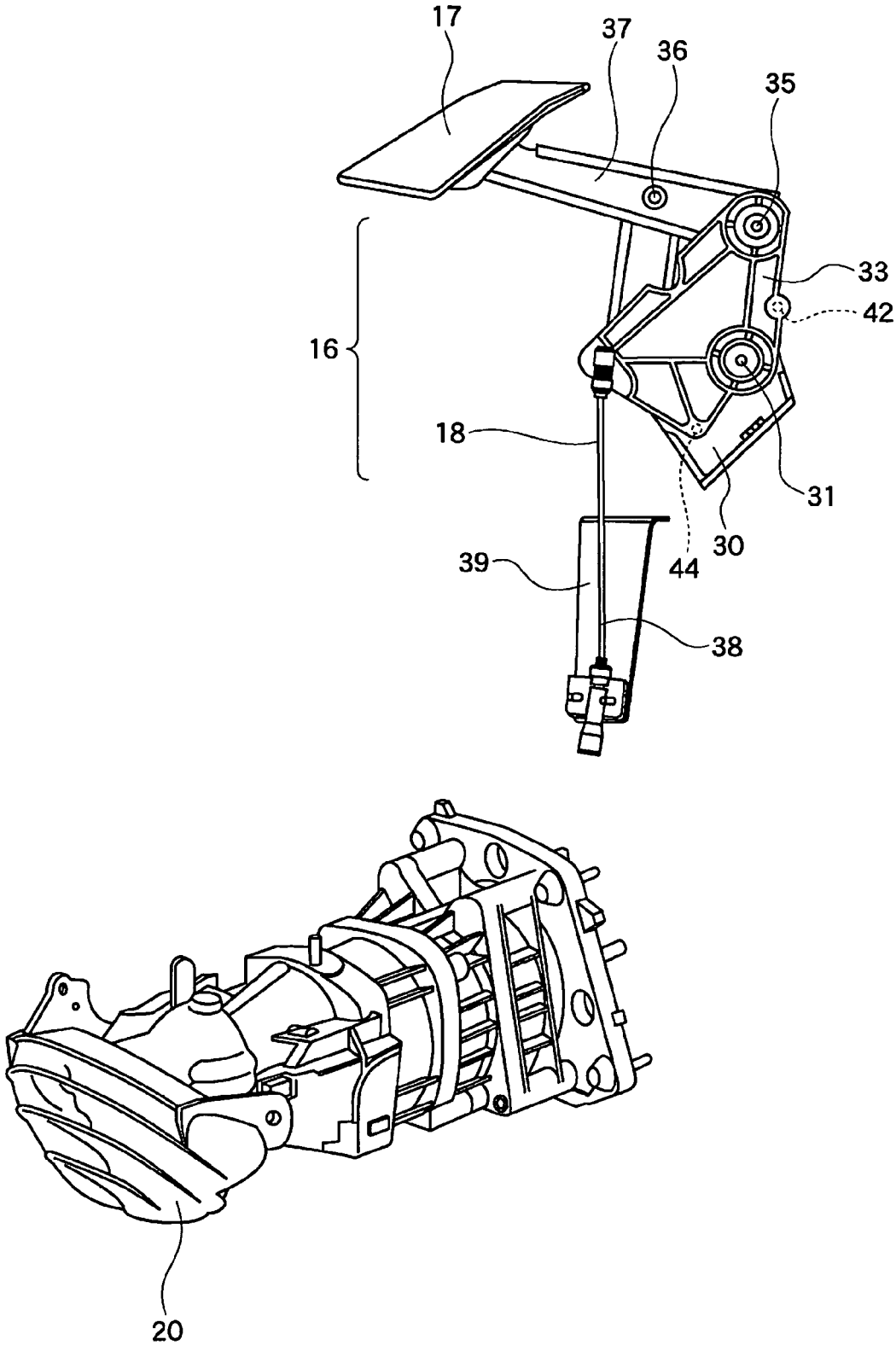
FIG. 9 is a schematic view showing a relation between the movement of the link mechanism and the reverse bucket when the watercraft is in the reverse thrust mode.

On the other hand, when the holding section 17 is pulled rearwardly, the bridging link 37 makes a rearward parallel motion and the right link 33 can be rotated counterclockwise about the second rotational shaft 31, as shown in FIG. 9. In this case, the wire 18 can be pushed down into the wire tube 38, and the movement of the holding section 17 can be transmitted to the advancing and reversing-changeover bucket 20 so that the opening of the nozzle 19 can be closed. As a result, even if a jet stream is emitted from the nozzle 19, it strikes against the advancing and reversing-changeover bucket 20 and can be directed back toward the front of the hull, resulting in a reversing state of the water-jet propulsion watercraft 10, or in other words, a reverse thrust mode.

Figure 5:
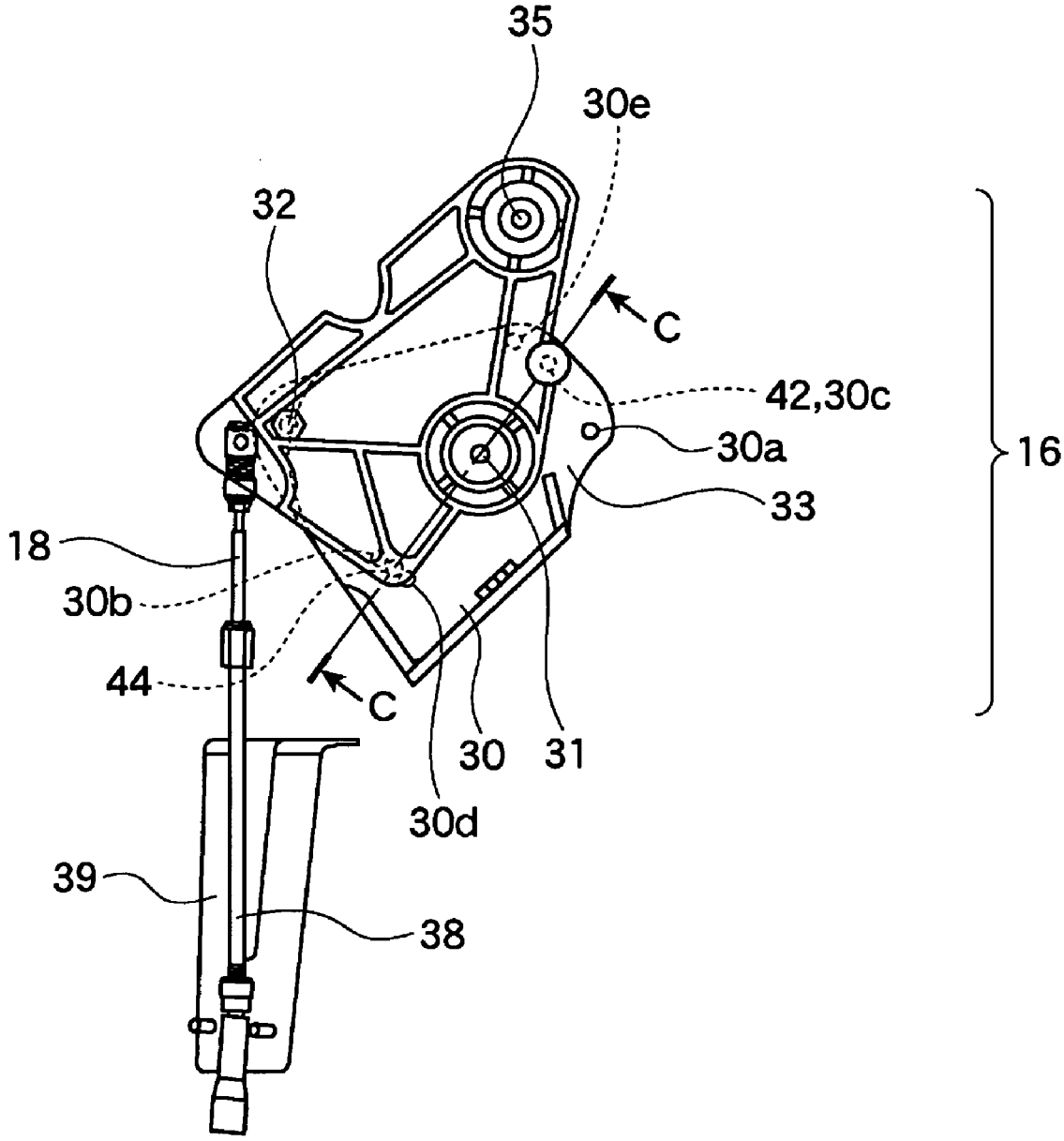
FIG. 5 is a side view of the link mechanism in a second dead slow position.
Figure 6:
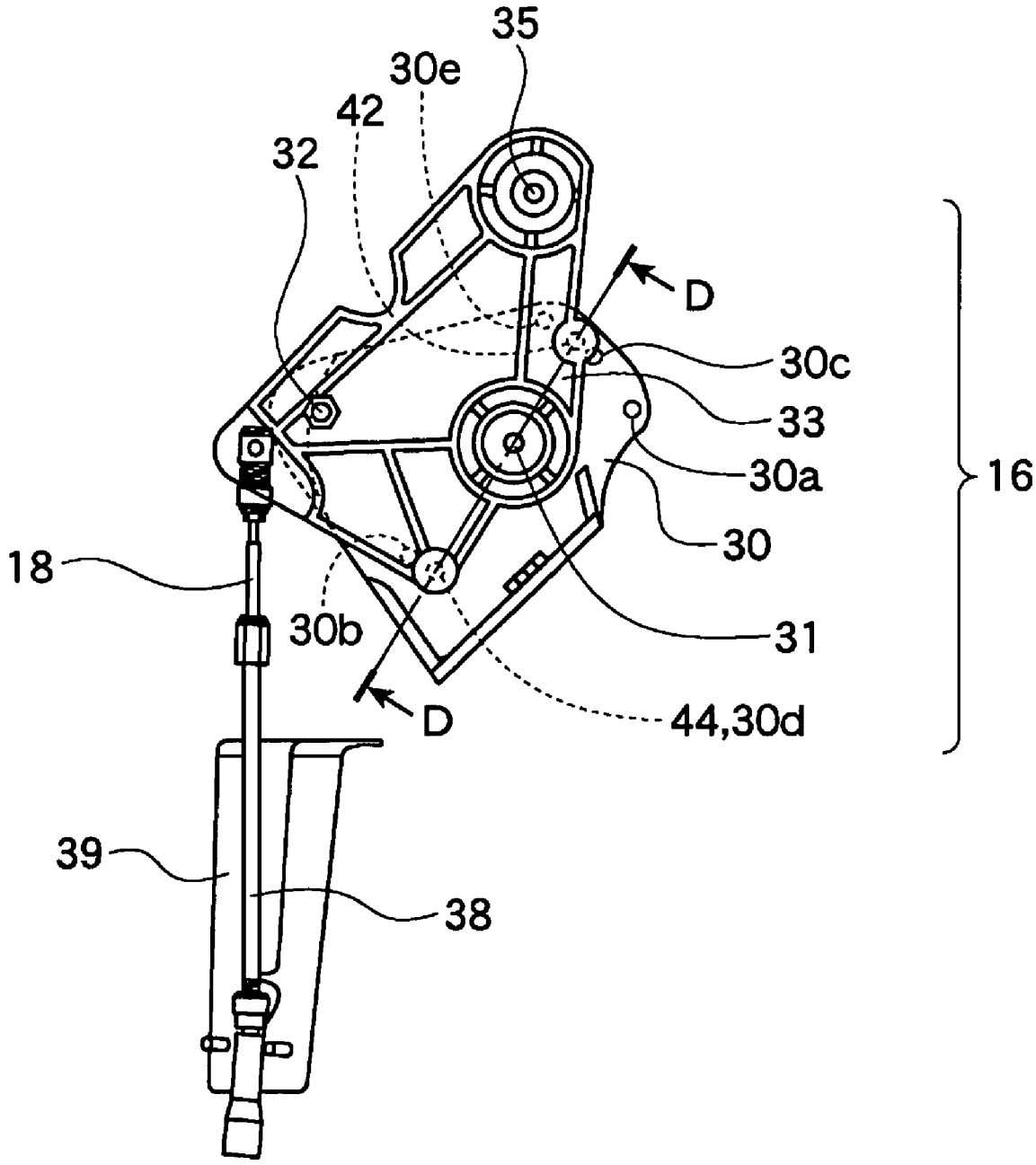
FIG. 6 is a side view of the link mechanism in a third dead slow position.
Figure 7:
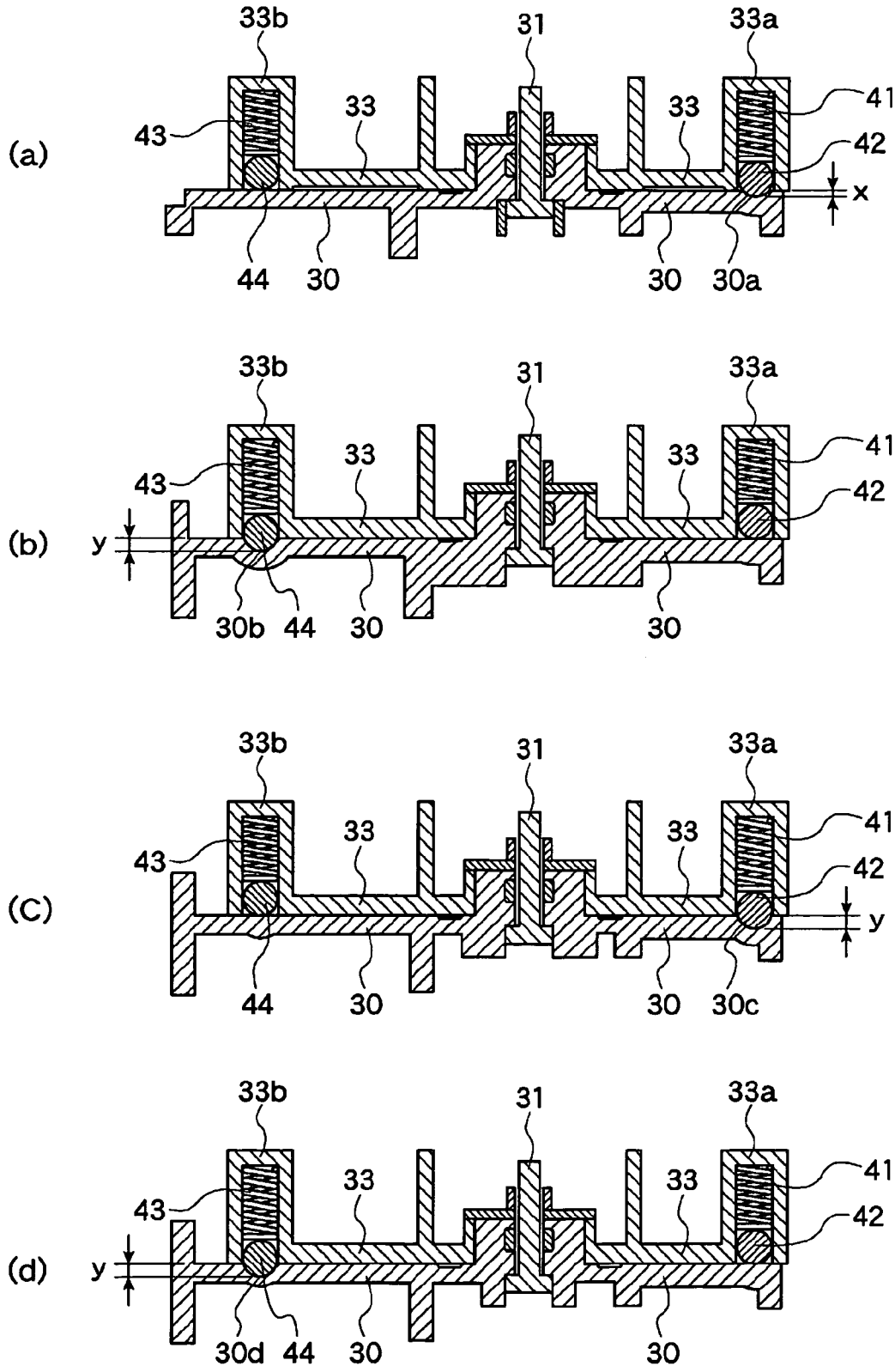
FIGS. 7(*a*), (*b*), (*c*), and (*d*) are schematic views of an upper ball and a lower ball being engaged with and disengaged from engagement recesses in the link mechanism according of FIGS. 2-6, FIG. 7(*a*) being a sectional view of the balls when the watercraft is in a forward thrust mode, taken along line A-A of FIG. 2, FIG. 7(*b*) being a sectional view of the balls when the watercraft is in the first dead slow position, taken along line B-B of FIG. 4, FIG. 7(*c*) being a sectional view of the balls when the watercraft is in the second dead slow position, taken along line C-C of FIG. 5, and FIG. 7(*d*) being a sectional view of the bails when the watercraft is in the third dead slow position, taken along line D-D of FIG. 6.

The link mechanism 16 can be provided, between the right link 33 and plate-like bracket 30, with a first click mechanism capable of locating the holding section 17 at a given position in the middle of the reciprocating stroke of the holding section 17, as shown in FIG. 2 through FIG. 6 (see FIG. 7).

The first click mechanism can be a mechanism such that click feelings (or tactile signals) are generated when the water-jet propulsion watercraft 10 is in a state of an advancing position (forward thrust), the states of a plurality of dead slow positions (intermediate thrust modes) and the state of a reversing position (reverse thrust mode).

The dead slow position refers to a state in which the water-jet propulsion watercraft 10 is not in a full forward thrust mode, nor the full reverse thrust mode. Rather, these positions refer to speeds in the lowest range. For example, in the case of an automobile, when the automobile is not in forward or reverse gear, it is in a neutral gear position, and thus, the automobile can coast to a stop. However, in the case of the water-jet propulsion watercraft 10, due to resistance forces by waves or winds or the inertia force and the like, watercraft generally do not always coast to a complete stop, even when its engine is idling or off. Therefore, for the water-jet propulsion watercraft 10 to be stopped and maintained as stationary as possible, the angle of the advancing and reversing-changeover bucket 20 can be more finely-adjusted, as well as the direction of a jet stream emitted from the nozzle 19, and reaction forces are given in the direction opposite to the moving direction of the watercraft 10.

The dead slow positions are provided in three states so that fine-adjustment can be performed in a plurality of stages. However, other numbers of such dead slow positions can also be used.

The first click mechanism includes, as shown in FIGS. 7(*a*) through (*d*), engagement recesses 30*a*-30*d* formed in the plate-like bracket 30, a first ball housing 33*a* formed approximately in the middle of the right link 33 between the first rotational shaft 31 and the rotational end 35, and a second ball housing 33*b* formed at a position in the right link 33 opposite to the first ball housing 33*a* around the first rotational shaft 31.

Further, the first click mechanism includes, as shown in FIGS. 7(*a*) through (*d*), a first spring 41 having a base end fixed inside the first ball housing 33*a*, a first ball 42 as an engagement projection mounted to the end of the first spring 41, a second spring 43 having a base end fixed inside the second ball housing 33*b*, and a second ball 44 as an engagement projection mounted to the end of the second spring 43.

These ball housings 33*a*, 33*b*, springs 41, 43 and balls 42, 44 are distributed oppositely on the plate-like bracket 30 around the first rotational shaft 31.

The first click mechanism can be configured such that click feelings are obtained when the water-jet propulsion watercraft 10 comes into the state of an advancing position, the state of a first dead slow position, the state of a second dead slow position, the state of a third dead slow position and the state of a reversing position. In addition, the first click mechanism has a depth y of the engagement recesses 30*b* through 30*d* at each dead slow position formed deeper than a depth x of the engagement recess 30*a* at the advancing position or an engagement recess 30*e* at the reversing position. That is, assuming the depth of the engagement recesses 30*b* through 30*d* be y and the depth of the engagement recesses 30*a*, 30*e* be x, they have a relation of y>x. The reason for this relation is that in the states of the advancing position and the reversing position, the advancing and reversing-changeover bucket 20 itself can be provided with a mechanism for fixing its inclination for the positioning, while in the state of each dead slow position, there is no such a mechanism for the positioning, and thus it is advantageous to generate a greater holding force with the balls 42, 44 engaged with the engagement recesses 30*b* through 30*d*.

Figure 2:
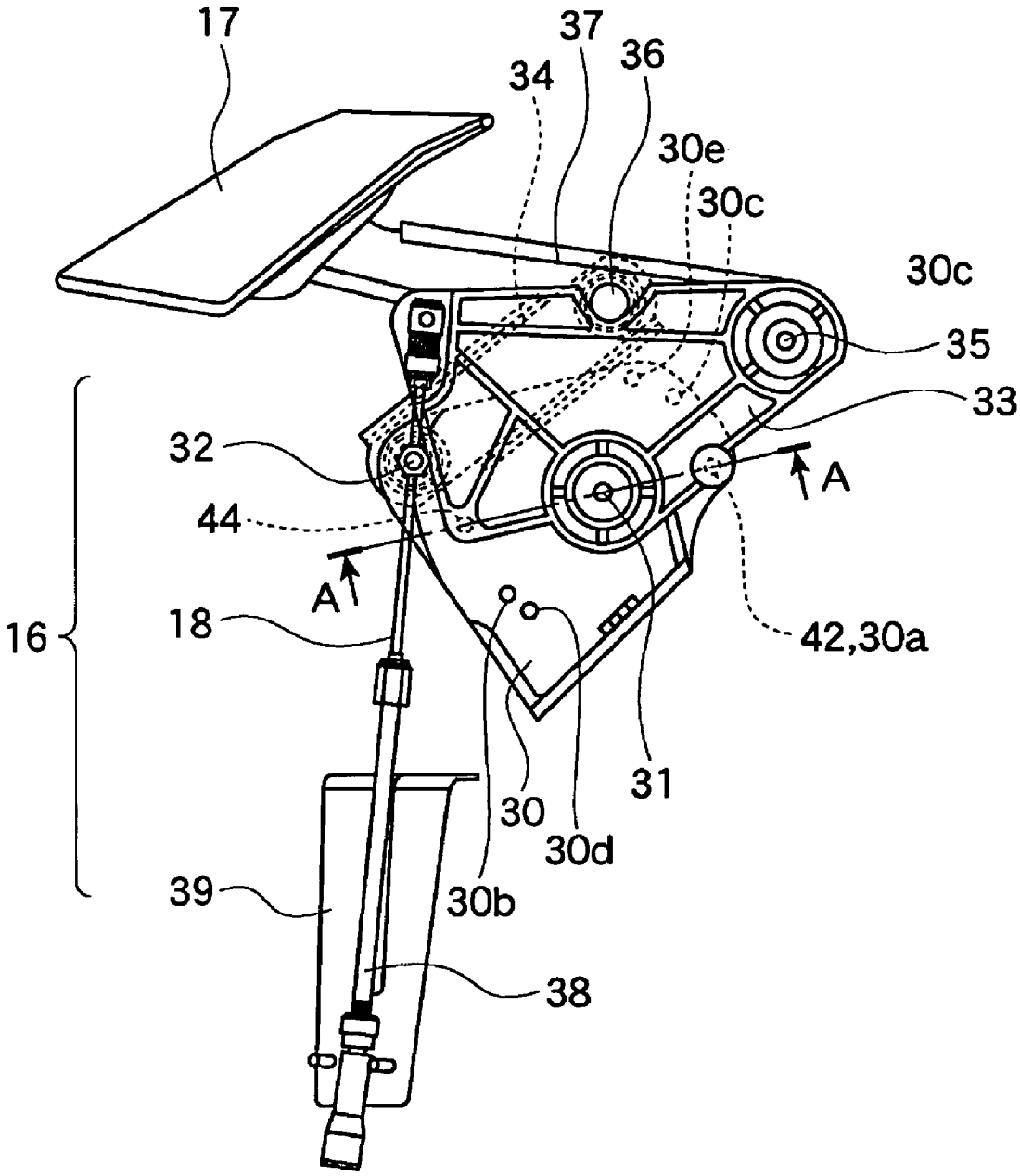
FIG. 2 is a side view showing a link mechanism for controlling the reverse bucket when the watercraft is in a forward thrust mode.

In the case where the water-jet propulsion watercraft 10 is in the state of advancing, the plate-like bracket 30 can be formed with an F engagement recess 30*a*, the right link 33 can be provided with a spring 41, and a ball 42 as an engagement projection, and the ball 42 can be engaged with the F engagement recess 30*a*, as shown in FIG. 2 and FIG. 7(*a*).

Figure 4:
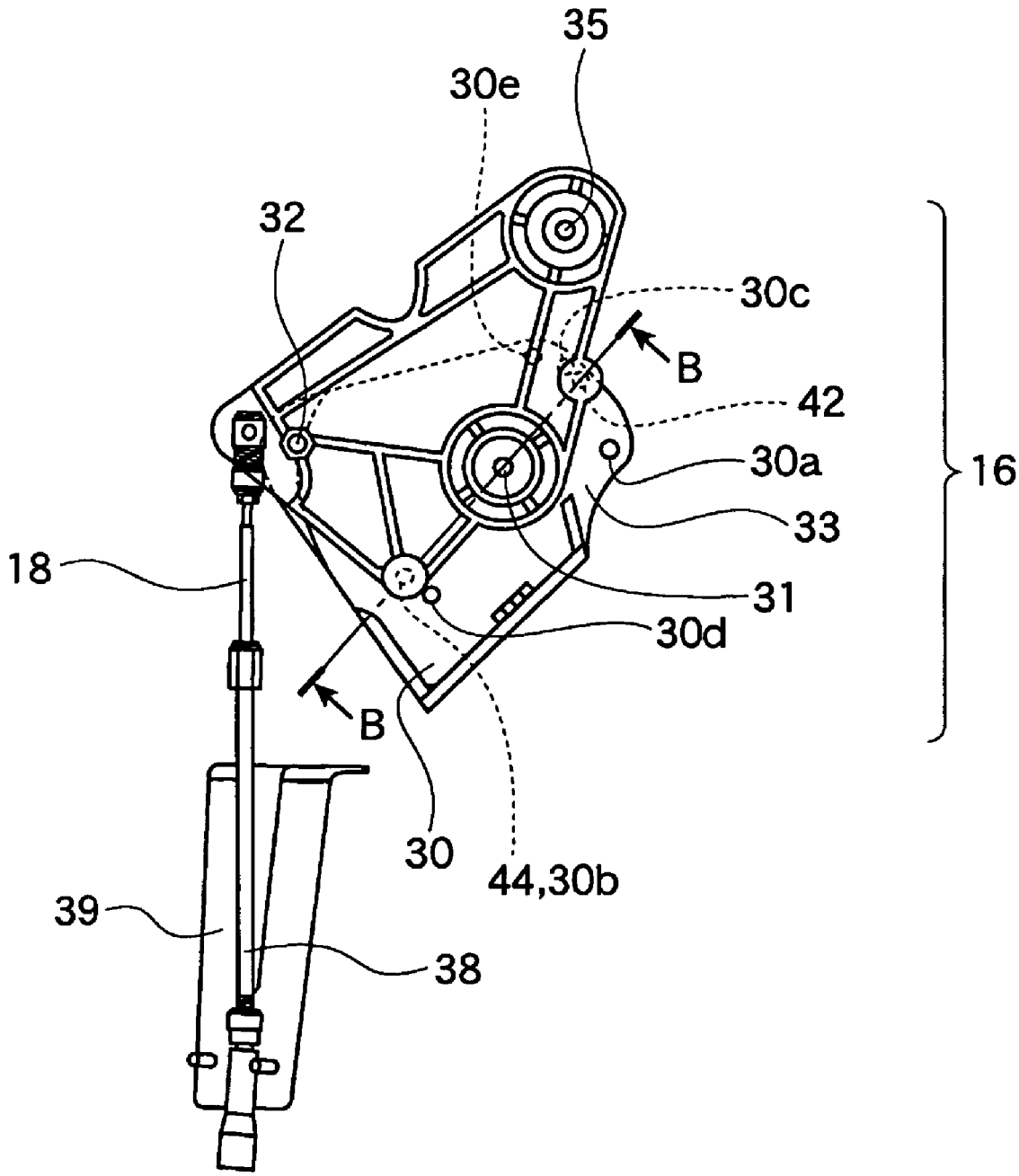
FIG. 4 is a side view of the link mechanism in a first dead slow position.

In the case where the water-jet propulsion watercraft 10 can be in the state of the first dead slow position, the plate-like bracket 30 can be formed with a first engagement recess 30*b*, the right link 33 can be provided with a spring 43 and a ball 44 as an engagement projection, and the ball 44 can be engaged with the first engagement recess 30*b*, as shown in FIG. 4 and FIG. 7(*b*).

In the case where the water-jet propulsion watercraft 10 is in the state of the second dead slow position, the plate-like bracket 30 can be formed with an second engagement recess 30*c*, the right link 33 can be provided with a spring 41 and a ball 42, and the ball 42 can be engaged with the second engagement recess 30*c*, as shown in FIG. 5 and FIG. 7(*c*).

In the case where the water-jet propulsion watercraft 10 is in the state of the third dead slow position, the plate-like bracket 30 can be formed with a third engagement recess 30*d*, the right link 33 can be provided with a spring 43 and a ball 44, and the ball 44 can be engaged with the third engagement recess 30*d*, as shown in FIG. 6 and FIG. 7(*d*).

Figure 3:
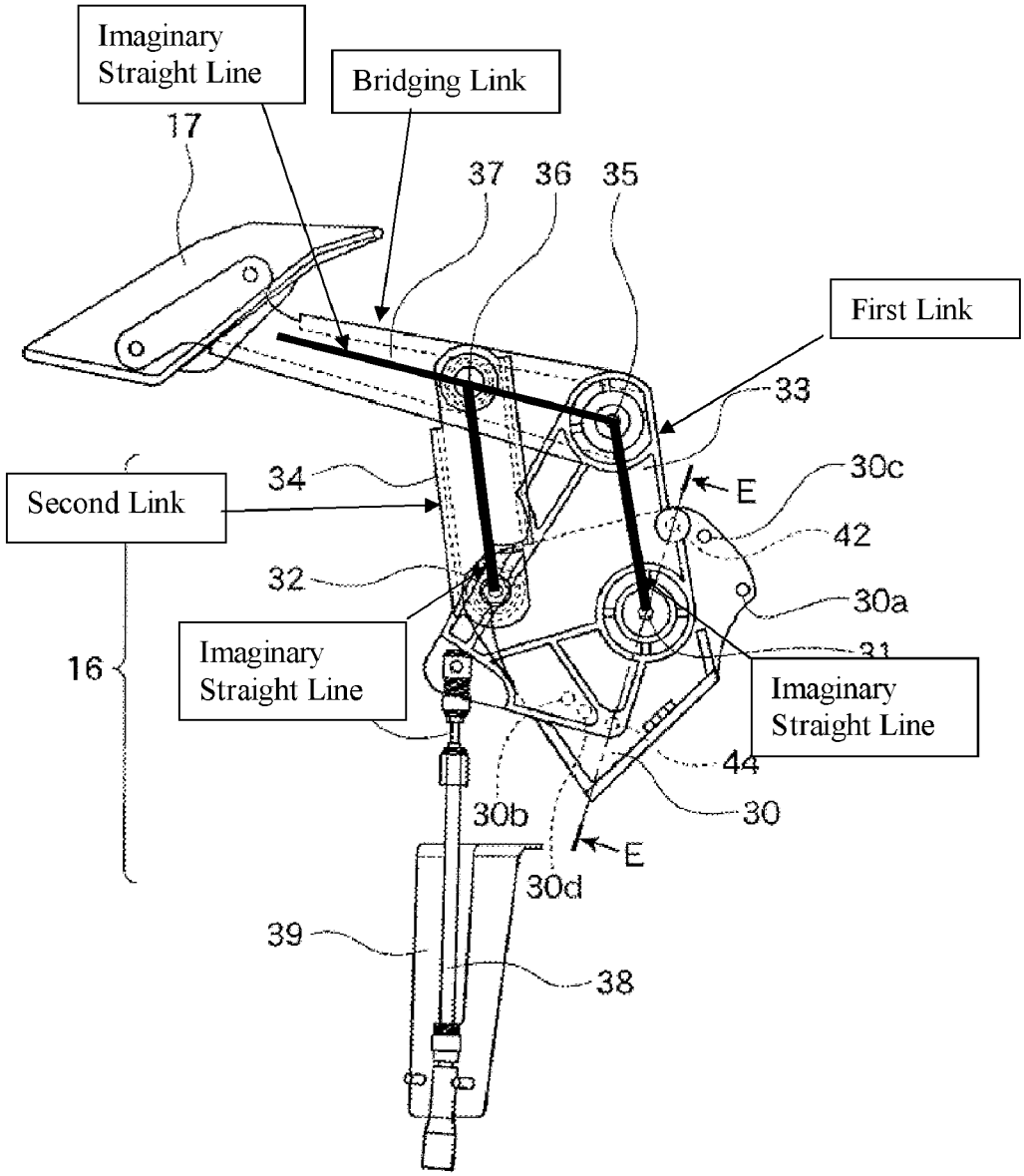
FIG. 3 is a side view showing the link mechanism when watercraft is in a reverse thrust mode.

In the case where the water-jet propulsion watercraft 10 is in the state of reversing, the plate-like bracket 30 can be formed with an R engagement recess 30*e*, the right link 33 can be provided with a spring 41 and a ball 42, and the ball 42 can be engaged with the R engagement recess 30*e*, as shown in FIG. 3.

Next, the relation between the holding section 17 and the cover 15 is described with reference to FIG. 10 and FIG. 2. The deck of the water-jet propulsion watercraft 10 can be covered by a cover 15. The cover 15 can be formed with an insertion opening 15*a* for the insertion of the bridging link 37, and after insertion of the bridging link 37, the right link 33 and the left link 34 can be disposed inside the opening 15*a*, with the holding section 17 disposed outside the insertion opening 15*a*.

If the bridging link 37 (which makes a parallel motion through reciprocating movement of the holding section 17) is inserted in the insertion opening 15*a*, as described above, there is no need of an insertion opening 15*a* being formed in a longitudinally-elongated shape across the deck surface significantly as in an operating member of the type in which the holding section 17 can be rotated by the end of the bridging link 37 on the control section 11 side. Therefore, since the moving range of the bridging link 37 can be decreased compared with the rotating type, the size of the insertion opening 15*a* can be smaller, thereby reducing the amount of water that can enter the watercraft 10 through the insertion opening 15*a*.

Figure 10:
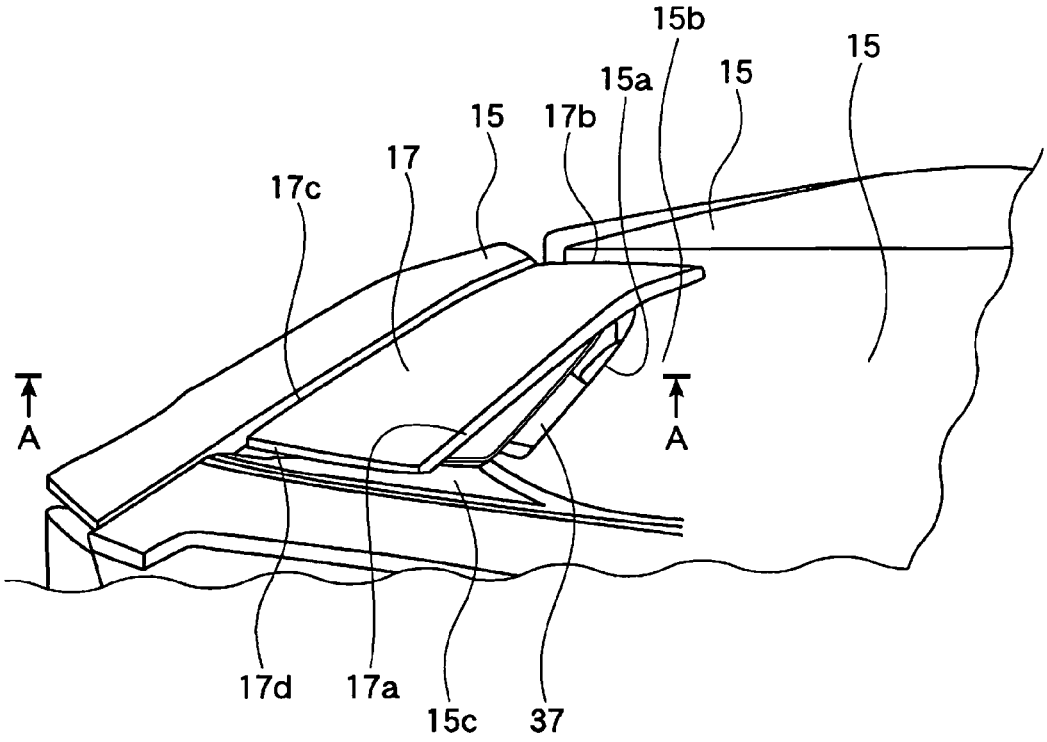
FIG. 10 is a perspective view showing a positional relation between a cover member and a holding section of the operation member for controlling movement of the reverse bucket.
Figure 11:
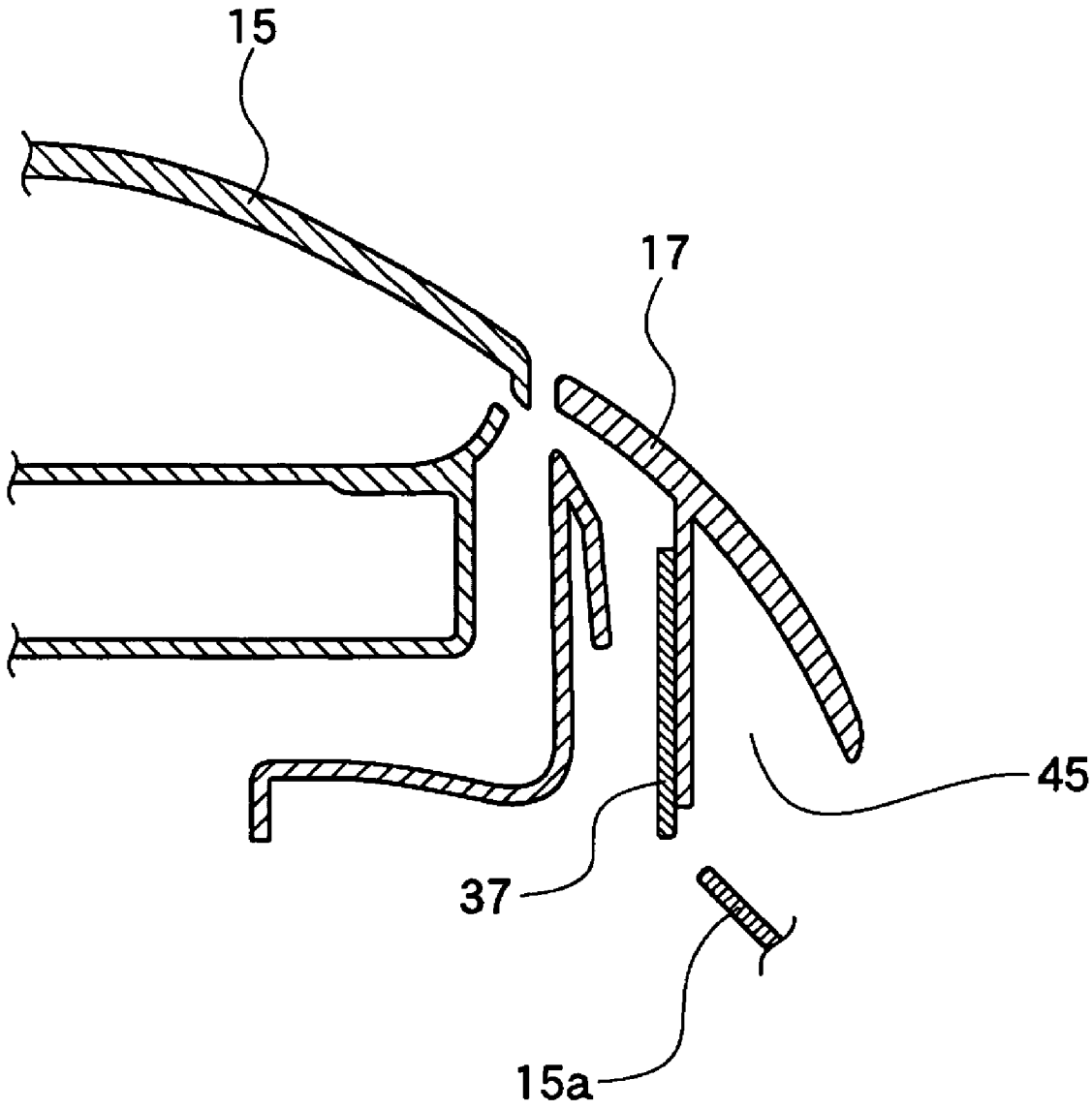
FIG. 11 is a sectional view of FIG. 10 showing the positional relation between the cover member and the holding section according to the embodiment.

The holding section 17 can be configured, as shown in FIG. 10 and FIG. 11, such that it is formed in the shape of a plate, and a clearance 45 for insertion of a hand is formed at a most advanced position in the back-and-forth operation stroke between one part of the peripheral edge of the plate-like holding section 17, or a right side edge 17*a*, and the cover 15, and the other parts of the peripheral edge of the plate-like holding section 17, or other side edges 17*b* through 17*d*, are flush with the cover 15.

That is, the cover 15 can be formed with a recess near the insertion opening 15*a*, and having a part of the recess, or an insertion side face 15*b*, and another part of the recess, or an insertion bottom 15*c*. In addition, the holding section 17 has a right side edge 17*a* and other side edges 17*b* through 17*d*.

In setting the water-jet propulsion watercraft 10 into the state of advancing, when the holding section 17 is pushed as shown in FIG. 10, the clearance 45 can be defined by the right side edge 17*a*, of the holding section 17 insertion side face 15*b* and insertion bottom 15*c*, as shown in FIG. 11. In addition, the other side edges 17*b* through 17*d* of the holding section 17 are flush with the cover 15.

The holding section 17 can be configured such that it is flush with the cover 15. Therefore, the insertion opening 15*a* can be covered by the holding section 17. As a result, the quality of external appearance of the water-jet propulsion watercraft 10 can be improved.

Further, the holding section 17 can be formed with a clearance 45 for insertion of a hand at a most advanced position in the back-and-forth operation stroke between the right side edge 17*a* and the cover 15. Therefore, an operator can be allowed to insert his or her hand in the clearance 45 to grasp the holding section 17. As a result, the holding section 17 can be operated easily.

Next, the function of an operating device of the water-jet propulsion watercraft 10 is described below.

If an operator intends to set the water-jet propulsion watercraft 10 into the state of advancing (see FIG. 2) from the state of reversing (see FIG. 3), when the operator pushes the holding section 17 in the condition of FIG. 3, the first link 33 can be rotated clockwise about the first rotational shaft 31 and the second link 34 clockwise about the second rotational shaft 32, and this movement of the rotational ends 35, 36 of the first link 33 and the second link 34 causes an approximately-forward parallel motion of the bridging link 37. In association with the rotation of the first link 33, the wire 18 attached to the plate-like bracket 30 can be pulled, to raise the advancing and reversing-changeover bucket 20, as shown in FIG. 8, resulting in the nozzle 19 in the state of opening. A jet stream emitted from the nozzle 19 flows rearward and the water-jet propulsion watercraft 10 will advance.

On the other hand, if an operator intends to set the water-jet propulsion watercraft 10 into the state of reversing (see FIG. 3) from the state of advancing (see FIG. 2), when the operator pulls the holding section 17, the first link 33 can be rotated counterclockwise about the first rotational shaft 31 and the second link 34 counterclockwise about the second rotational shaft 32, and this movement of the rotational ends 35, 36 of the first link 33 and the second link 34 causes an approximately-rearward parallel motion of the bridging link 37. In association with the rotation of the first link 33, the wire 18 attached to the plate-like bracket 30 can be pushed down, to lower the advancing and reversing-changeover bucket 20, as shown in FIG. 9, resulting in the nozzle 19 in the state of being closed. A jet stream emitted from the nozzle 19 strikes against the bucket 20 and flows forwardly, so that the water-jet propulsion watercraft 10 reverses gradually.

In the course of the shifting operation between these advancing and reversing states, if an operator shifts into the state of advancing position, the states of a first through a third dead slow positions and the state of reversing position, the click mechanism 16 will function. Since the direction of the jet stream emitted from the nozzle 19 can be adjusted separately in three stages between the full advancing and full reversing modes, the movement of the propulsion watercraft 10 can be more finely-adjusted in the course of transition from the state of advancing or reversing to the state of stopping.

Next, the function of a first click mechanism in the course of transition from the state of advancing to the state of reversing is described.

When the holding section 17 is in the state of advancing shown in FIG. 2, the first ball 42 of the right link 33 can be engaged with the F engagement recess 30*a* of the plate-like bracket 30, as shown in FIG. 7(*a*), the inclination of the bucket 20 can be fixed by a mechanism of the advancing and reversing-changeover bucket 20 itself, and the water-jet propulsion watercraft 10 can be shifted into the state of advancing.

When the holding section 17 is in the state of the first dead slow position shown in FIG. 4, the second ball 44 of the right link 33 can be engaged with the first engagement recess 30*b* of the plate-like bracket 30, as shown in FIG. 7(*b*).

When the holding section 17 is in the state of the second dead slow position shown in FIG. 5, the first ball 42 of the right link 33 can be engaged with the second engagement recess 30*c* of the plate-like bracket 30, as shown in FIG. 7(*c*).

When the holding section 17 is in the state of the third dead slow position shown in FIG. 6, the second ball 44 of the right link 33 can be engaged with the third engagement recess 30*d* of the plate-like bracket 30, as shown in FIG. 7(*d*).

When the holding section 17 is in the state of reversing shown in FIG. 3, the first ball 42 of the right link 33 can be engaged with the engagement recess 30*e*, the inclination of the bucket 20 can be fixed by a mechanism of the advancing and reversing-changeover bucket 20 itself, and the water-jet propulsion watercraft 10 can be shifted into the state of reversing.

Further, the function of the first click mechanism in the course of transition from the state of reversing to the state of advancing can be performed following the course opposite to the foregoing transition course from the state of advancing to the state of reversing.

According to the operating device of the water-jet propulsion watercraft 10 as described above, the bridging link 37 can move in parallel. Therefore, since the holding section 17 can be operated through an approximately straight motion rather than a circular motion, the amount of movement can be decreased. As a result, the advancing and reversing-changeover bucket 20 can be operated without need of the operator's arm or body being moved significantly, and the bridging link 37 can be operated without interference with other members around the bridging link 37.

Further, at least a control section 11 side end of the bridging link 37 and a portion near the control section side end are approximately parallel to an imaginary straight line connecting the rotational ends 35, 36. Therefore, through a parallel motion of the bridging link 37 supporting the holding section 17 and without need of the bridging link 37 being moved across the deck surface significantly as in an operating member of the type with a rotating holding section 17, the moving range of the bridging link 37 can be decreased, as well as the size of the insertion opening 15*a* to a smallest minimum. As a result, ingress of water from the insertion opening 15*a* during traveling can be further reduced.

Further, a bridging link 37 can be disposed between the right link rotational end 35 of the right link 33 and the left link rotational end 36 of the left link 34. Therefore, the load applied by an operator to the holding section 17 can be transmitted to the right link 33 and the left link 34 through the bridging link 37 in a laterally dispersed relation. As a result, loads applied to the link mechanism 16 on both left and right sides thereof are well-balanced, improving durability of the link mechanism 16.

Further, the first link 33 can be supported on the plate-like bracket 30 at one side and the second link 34 on the plate-like bracket 30 at the other side. If both of the first link 33 and the second link 34 are supported on the plate-like bracket 30 at one side and the first link 33 or the second link 34 has a large thickness, they might interfere with each other at the time of rotation and the distance between the first rotational shaft 31 and the second rotational shaft 32 should be increased to avoid the interference. However, since the first and second links 33, 34 are supported separately on the plate-like bracket 30 at both sides, the distance between the first rotational shaft 31 and the second rotational shaft 32 can be reduced, providing a compact structure of the link mechanism 16.

Further, there can be provided a first click mechanism capable of locating the holding section 17 at a given intermediate position along its reciprocating stroke. Therefore, in the course of reciprocating the holding section 17, operations, for example, for the state of an advancing position, the states of dead slow positions in the lowest speed range and the state of a reversing position, can be distinguished by the operator by way of the click feelings or "tactile signals". As a result, operating properties of the water-jet propulsion watercraft 10 can be improved.

Further, the first click mechanism can be configured such that click feelings are obtained at a plurality of dead slow positions. Therefore, the speed of the water-jet propulsion watercraft 10 moving back and forth in the lowest speed range, can be more finely-adjusted. As a result, even if the water-jet propulsion watercraft 10 is in a condition of not being likely to stop or continues to move slowly on the water due to external forces by waves or winds or the inertia of the water-jet propulsion watercraft itself, and the like, the position of the water-jet propulsion watercraft 10 can be more finely-adjusted easily on the water.

Further, the first click mechanism can be provided, in the plate-like bracket 30, with a plurality of engagement recesses 30(*b*) through 30(*d*) being distributed oppositely around the first rotational shaft 31. If the engagement recesses 30(*b*) through 30(*d*) are provided serially in a given area, positions at which the balls 42, 44 and the engagement recesses 30(*b*) through 30(*d*) are concentrated, so that the right link 33 will be inclined gradually to the plate-like bracket 30 with a long-term use and a deviation might be produced in the arrangement of the link mechanism 16. However, since the engagement recesses 30(*b*) through 30(*d*) are located in a distributed relation, such a deviation is not likely to be produced, and forces applied to the right link 33 and the plate-like bracket 30 through engagement are well-balanced.

Further, the depth y of the engagement recesses 30(*b*) through 30(*d*) formed at dead slow positions can be deeper than the depth y of the F engagement recess 30(*a*) formed in the state of advancing or the R engagement recess 30(*e*) formed in the state of reversing. In the state of advancing or the state of reversing, the inclination of the bucket 20 can be fixed by a mechanism of the advancing and reversing-changeover bucket 20 itself in addition to the first click mechanism, but at dead slow positions, the inclination of the bucket 20 may be fixed only by the first click mechanism as in the embodiment of this invention. Therefore, if the depth of the engagement recesses is deeper, more reliable engagement can be effected for that, and also at dead slow positions, the ball 42, 44 can be engaged with the engagement recesses 30(*b*) through 30(*d*) formed at the dead slow positions to fix the inclination of the bucket as reliable as if a mechanism of advancing and reversing-changeover bucket 20 itself were provided. As a result, the mechanism can be shifted into the dead slow positions easily and reliably.

Further, to a region spaced from the rotational ends 35, 36 of the right link 33 or the left link 34, that is, to the corner of the right link 33 can be coupled the wire 18 for transmitting the movement of the holding section 17 to the advancing and reversing-changeover bucket 20. Therefore, the moving direction and the displacement of the wire 18 can be set irrespective of those of the holding section 17. As a result, the degree of freedom can be increased.

Although in the above embodiments, the bridging link 37 can be formed assuming a straight line, the present inventions are not limited to those foregoing embodiments. That is, even if the control section 11 side end of the bridging link 37 and a portion near the control section side end thereof were not in line with the rotational ends 35, 36, it is satisfactory if they extend approximately parallel to an imaginary straight line connecting the rotational ends 35, 36. In other words, if the bridging link 37 can be configured such that a portion connecting the rotational ends 35, 36 and a portion near the holding section 17 are formed parallel to each other, the bridging link 37 may be bent in the middle between these portions.

Further, although in some of the above-described embodiments the reciprocating movement of the holding section 17 is transmitted to the advancing and reversing-changeover bucket 20 through the right link 33, left link 34 and bridging link 37, the present inventions are not limited to such embodiments. Rather, the parallel motion of the holding link 17 can be utilized for other uses. That is, an arrangement is possible such that movement of the holding section 17 is transmitted to the engine output control device, or a throttle.

Further, although in some of the above-described embodiments, the click mechanism 16 is arranged such that the right link 33 can be provided with springs 41, 43 and balls 42, 44 and the plate-like bracket 30 with engagement recesses 30(*a*) through 30(*e*), the present inventions are not limited to such embodiments. Rather, an arrangement is possible such that the right link 33 is provided with engagement recesses 30(*a*) through 30(*e*) and the plate-like bracket 30 with springs 41, 43 and balls 42, 44.

Further, although in some of the above-described embodiments a click feeling is obtained in either of the state of advancing and the state of reversing, the present inventions are not limited to such embodiments. That is, it is possible that an arrangement in which a click feeling is obtained for the state of advancing, and an arrangement in which a click feelings are not generated for the state of reversing. For example, when the watercraft 10 is operating in a forward thrust mode at an elevated speed, the hull vibrates, and with only the inclination fixing mechanism of the bucket 20, there is a possibility that the bucket 20 can fall out of the full forward thrust mode, and thus interfere with the water jet discharged from the steering nozzle 19. Thus, with the additional holding power of the above-described ball and detent mechanism, or other mechanisms, the bucket 20 can be more reliably held state of advancing, an arrangement in which a click feeling can be obtained, is adopted, while as for the state of reversing, since the traveling speed is relatively low, there may be no need of adopting such an arrangement. Therefore, regarding the state of reversing, an arrangement may be such that the engagement recess 30*e* is not provided so that its engagement with the ball 44 is avoided.

Further, although in some of the embodiments the dead slow positions are provided in three stages, the present inventions are not limited to such embodiments. For example, if finer adjustments are desired, the number of engagement recesses corresponding to the dead slow positions can be increased.

Figure 12:
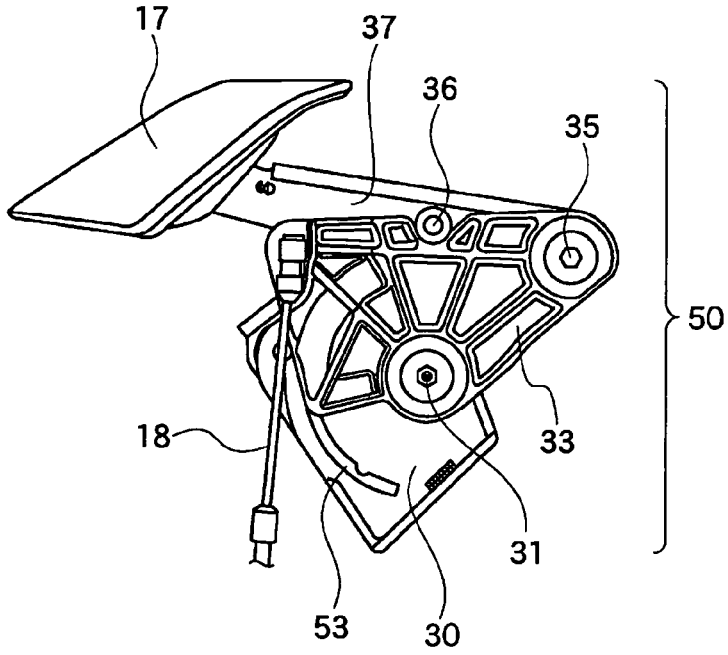
FIG. 12 are views showing the structure of a link mechanism including a plate-like bracket and a first link according to another embodiment, FIG. 12(*a*) being a side view of the link mechanism, and FIG. 12(*b*) being an enlarged partial side view of FIG. 12(*a*).
Figure 12:
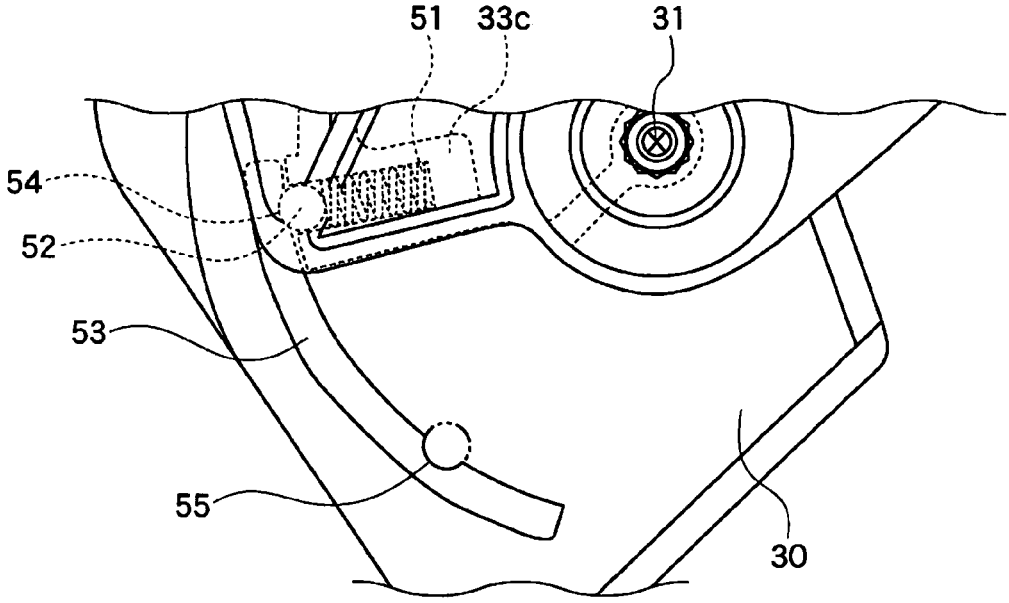

FIGS. 12(*a*) through (*b*) show additional modifications than can be used with the watercraft 10. In these figures, parts described above are designated by like reference numerals. In the following embodiments a second click mechanism can be used in place of the first click mechanism.

In the second click mechanism, a lower ball housing 33*c* can be formed in the plate-like bracket 30 side surface of a right link 33. The base end portion of an axially right-angled spring 51 can be provided in the lower ball housing 33*c* and an axially right-angled ball 52 as an engagement projection can be mounted at the end of the axially right-angled spring 51.

In addition, the second click mechanism can be provided with a grooved wall 53 in one side surface of a plate-like bracket 30 at one side and can be formed with an F engagement groove 54 as an engagement recess, and a dead slow engagement groove 55 can be provided as another engagement recess.

The second click mechanism can be configured such that the axis of the axially right-angled spring 51 can be disposed perpendicular to a first rotational shaft 31 and the axially right-angled ball 52 moves in the direction perpendicular to the first rotational shaft 31 to be engaged with the F engagement groove 54 and dead slow engagement groove 55. Therefore, when the axially right-angled ball 52 can be engaged with the F engagement groove 54 and dead slow engagement groove 55, the direction of engagement can be axially at right angles to the first rotational shaft 31.

If a plastic or the like is used as a material of the plate-like bracket 30 and the links 33, 34 for weight saving and if the direction of engagement of the balls 42, 44 with the engagement recesses 30(*a*) through 30(*d*) is parallel to the first rotational shaft 31, as some of the above embodiments, the right link 33 can be separated from the plate-like bracket 30 into the state of opening with a long-term use. However, since the F engagement groove 54 and dead slow groove 55 are engaged with the axially right-angled ball 52 axially at right angle, the right link 33 and the plate-like bracket 30 are not likely to be in the state of opening therebetween.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. An operation device for a water-jet propulsion watercraft comprising:

a first and a second rotational shaft provided parallel to each other in a hull of the watercraft;

a first link rotatable about the first rotational shaft and a second link rotatable about the second rotational shaft;

a bridging link coupling a rotational end of the first link with a rotational end of the second link such that an imaginary straight line connecting the rotational end of the first link to the first rotational shaft is parallel to an imaginary straight line connecting the rotational end of the second link to the second rotational shaft when viewed along a rotational axis of the first rotational shaft, the bridging link having at least an operator's seat side end and a portion near the operator's seat side end extending approximately parallel to an imaginary straight line connecting the rotational ends and capable of moving in parallel; and a holding section provided on the bridging link to be held and operated by an operator of the watercraft;

wherein a reciprocating movement of the holding section is transmitted to an engine output control device or a propelling direction changing device through the bridging link, the first link, and the second link.

2. The operation device for a water-jet propulsion watercraft of claim 1, wherein a deck of the watercraft is covered by a cover having an insertion opening, the bridging link being inserted through the insertion opening, the holding section being disposed outside the cover, and the first and second link are disposed inside the cover.

3. The operation device for a water-jet propulsion watercraft of claim 1, wherein the holding section is configured such that it is formed in the shape of a plate, a clearance for insertion of a hand is formed between one part of the peripheral edge of the plate-like holding section and the cover at a most advanced position of its back-and-forth operational movement, and the other part of the peripheral edge of the plate-like holding section is formed flush with the cover.

4. The operation device for a water-jet propulsion watercraft of claim 2, wherein the first link is supported on a plate-like bracket fixed to the deck at one side and the second link is supported on the plate-like bracket at the other side, and the bridging link is disposed between the first and the second link when viewed in the direction perpendicular to the first and second rotational shafts.

5. The operation device for a water-jet propulsion watercraft of claim 3, wherein the first link is supported on a plate-like bracket fixed to the deck at one side and the second link is supported on the plate-like bracket at the other side, and the bridging link is disposed between the first and the second link when viewed in the direction perpendicular to the first and second rotational shafts.

6. The operation device for a water-jet propulsion watercraft of claim 4 additionally comprising a click mechanism configured to maintain the holding section at a predetermined position along the range of movement of the holding section, the click mechanism being provided between at least either one of the first and the second link and the plate-like bracket.

7. The operation device for a water-jet propulsion watercraft of claim 6, wherein the click mechanism is configured such that click feelings are generated at a plurality of dead slow positions at which the water-jet propulsion watercraft is adjusted to a plurality of low speeds.

8. The operation device for a water-jet propulsion watercraft of claim 6, wherein the click mechanism is provided, in the plate-like bracket, with a plurality of engagement recesses or engagement projections such that either one of the engagement recesses and the engagement projections are distributed oppositely around the first rotational shaft, and at least either one of the first and the second link is provided with a plurality of engagement projections or engagement recesses to be engaged with the engagement recesses or the engagement projections.

9. The operation device for a water-jet propulsion watercraft of claim 7, wherein the click mechanism is provided, in the plate-like bracket, with a plurality of engagement recesses or engagement projections such that either one of the engagement recesses and the engagement projections are distributed oppositely around the first rotational shaft, and at least either one of the first and the second link is provided with a plurality of engagement projections or engagement recesses to be engaged with the engagement recesses or the engagement projections.

10. The operation device for a water-jet propulsion watercraft of claim 6, wherein the click mechanism is provided with engagement projections and engagement recesses such that the direction of engagement of each pair of the engagement projections and the engagement recesses is axially at right angles to the first rotational shaft.

11. The operation device for a water-jet propulsion watercraft of claim 8, wherein the click mechanism is formed such that the depth of the engagement recesses formed at the dead slow positions is deeper than the depth of the engagement recess formed at an advancing position or the engagement recess formed at a reversing position.

12. The operation device for a water-jet propulsion watercraft of claim 1 additionally comprising power transmission means for transmitting the movement of the holding section to the engine output control device or the propelling direction changing device is coupled to the first or the second link in a region spaced from the rotational ends.

13. An operation device for a water-jet propulsion watercraft comprising:

a first and a second rotational shaft mounted parallel to each other in a hull of the watercraft;

a first link having a first connection portion and a second connection portion, the first connection portion being rotatably connected to the first rotational shaft;

a second link having a first connection portion and a second connection portion, the first connection portion being rotatably connected to the second rotational shaft;

a third link coupling the second connection portion of the first link with the second connection portion of the second link, the third link having at least an operator's seat side, and wherein the third link is configured such that the seat side end moves in a generally straight line; and a holding section provided on the third link configured to be held and operated by an operator of the watercraft;

wherein a reciprocating movement of the holding section is transmitted to an engine output control device or a propelling direction changing device through the third link, the first link, and the second link.

14. The operation device for a water-jet propulsion watercraft of claim 13, wherein a deck of the watercraft is covered by a cover having an insertion opening, the third link being inserted through the insertion opening, the holding section being disposed outside the cover, and the first and second link are disposed inside the cover.

15. The operation device for a water-jet propulsion watercraft of claim 13, wherein the holding section is configured such that it is formed in the shape of a plate, a clearance for insertion of a hand is formed between one part of the peripheral edge of the plate-like holding section and the cover at a most advanced position of its back-and-forth operational movement, and the other part of the peripheral edge of the plate-like holding section is formed flush with the cover.

16. The operation device for a water-jet propulsion watercraft of claim 14, wherein the first link is supported on a plate-like bracket fixed to the deck at one side and the second link is supported on the plate-like bracket at the other side, and the third link is disposed between the first and the second link when viewed in the direction perpendicular to the first and second rotational shafts.

17. The operation device for a water-jet propulsion watercraft of claim 13 additionally comprising a click mechanism configured to maintain the holding section at a predetermined position along a range of movement of the holding section, the click mechanism being provided between at least either one of the first and the second link and the plate-like bracket.

* * * * *

UNITED STATES PATENT AND TRADEMARK OFFICE

CERTIFICATE OF CORRECTION

PATENT NO. : 7,422,499 B2
APPLICATION NO. : 11/366276
DATED : September 9, 2008
INVENTOR(S) : Akira Nakatsuji It is certified that error appears in the above-identified patent and that said Letters Patent is hereby corrected as shown below:

Please replace Figure 3 with the Figure below.

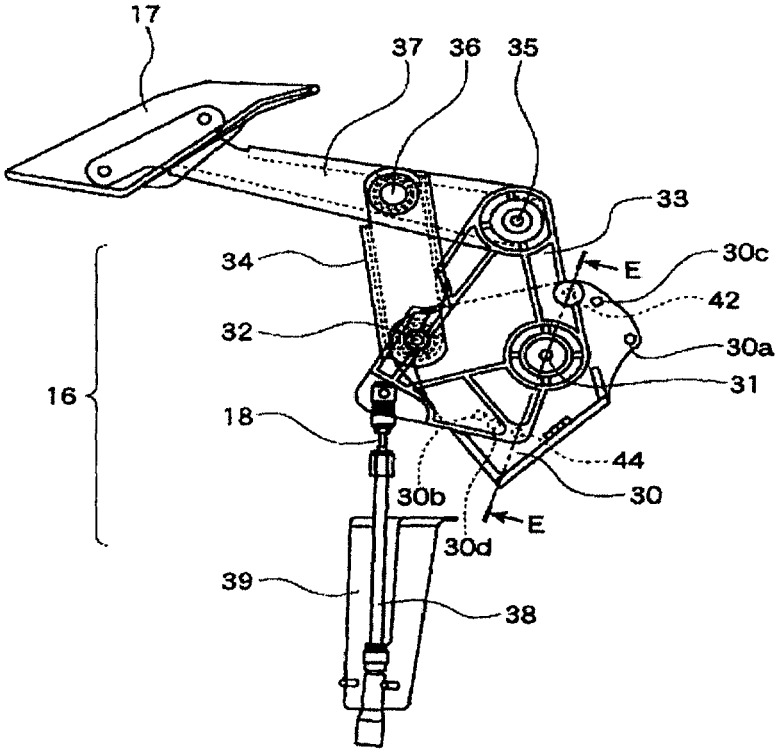

*Figure 3*

In Column 1, Line 56, please change "bull" to --hull--.

In Column 2, Line 12, please change "right" to --might--.

In Column 3, Line 11, please change "bails" to --balls--.

Signed and Sealed this

Eleventh Day of May, 2010

David J. Kappos

David J. Kappos
*Director of the United States Patent and Trademark Office*